US012618239B2

(12) United States Patent
Wiśniewski et al.

(10) Patent No.: US 12,618,239 B2
(45) Date of Patent: May 5, 2026

(54) ROOF COVERING ELEMENT, MODULAR ROOFING SHEET

(71) Applicant: WIĘCEK BUDMAT, Plock (PL)

(72) Inventors: Marek Wiśniewski, Plońsk (PL); Bogdan Więcek, Plock (PL)

(73) Assignee: WIECEK BUDMAT, Plock (PL)

( * ) Notice: Subject to any disclaimer, the term of this patent is extended or adjusted under 35 U.S.C. 154(b) by 108 days.

(21) Appl. No.: 18/286,124

(22) PCT Filed: Apr. 8, 2022

(86) PCT No.: PCT/PL2022/050020

§ 371 (c)(1),
(2) Date: Oct. 8, 2023

(87) PCT Pub. No.: WO2022/216165

PCT Pub. Date: Oct. 13, 2022

(65) Prior Publication Data

US 2024/0191505 A1 Jun. 13, 2024

(30) Foreign Application Priority Data

Apr. 8, 2021 (PL) ..... 437526

(51) Int. Cl.
*E04D 3/24* (2006.01)
*E04D 1/26* (2006.01)
(Continued)

(52) U.S. Cl.
CPC ..... *E04D 3/24* (2013.01); *E04D 1/265* (2013.01); *E04D 3/30* (2013.01); *E04D 3/32* (2013.01); *E04D 3/34* (2013.01)

(58) Field of Classification Search
CPC .. E04D 1/265; E04D 1/26; E04D 3/30; E04D 3/24; E04D 3/32; E04D 3/34
See application file for complete search history.

(56) References Cited

U.S. PATENT DOCUMENTS 4,617,773 A * 10/1986 Studwell ..... E04D 3/30 52/537
4,932,184 A * 6/1990 Waller ..... E04D 3/24 52/542

(Continued)

FOREIGN PATENT DOCUMENTS

EP 0115968 6/1987
WO 2013157968 10/2013

*Primary Examiner* — Andrew J Triggs
(74) *Attorney, Agent, or Firm* — SOROKER AGMON NORDMAN RIBA

(57) ABSTRACT

A roof covering element, a modular roofing sheet, made of a plate material, consisting of a first and second side edge, an upper edge and a lower edge, having a series of modules substantially parallel to the side edges forming at least one surface, containing ribs (walls) parallel to the upper and lower edges, characterised by that between an upper wall (5) and an ending surface (4) of the roof covering element (1) there is an upper crease (8) forming an obtuse angle with the ending surface (4) of the roof covering element (1); between each of {n} central walls (6) and each of {n} surfaces (3) there is a central crease (9) forming an obtuse angle with a central wall (6) and an obtuse angle with the surface (3); between a lower wall (7) and an extreme lower surface (2) there is a lower crease (10) forming an obtuse angle with the lower wall (7) and an obtuse angle with the extreme lower surface (2), wherein n is a natural number of n>0.

11 Claims, 9 Drawing Sheets

(51) Int. Cl.

| | |
|---|---|
| *E04D 3/30* | (2006.01) |
| *E04D 3/32* | (2006.01) |
| *E04D 3/34* | (2006.01) |

(56) References Cited

U.S. PATENT DOCUMENTS

| | | | | |
|---|---|---|---|---|
| 5,295,338 | A * | 3/1994 | Guffey | E04D 3/40 52/478 |
| 5,752,355 | A * | 5/1998 | Sahramaa | E04D 1/26 52/525 |
| 9,493,953 | B2 * | 11/2016 | Chabowski | E04D 3/365 |
| 2024/0191505 | A1 * | 6/2024 | Wisniewski | E04D 1/265 |

* cited by examiner

ROOF COVERING ELEMENT, MODULAR ROOFING SHEET

The present invention relates to a roof covering element, a modular roofing sheet.

A roof covering element, a modular roofing sheet, is traditionally made in a bending technology, with bending at angle of 90° which stretches a sheet and lacquer and results in micro-cracks of lacquer and corrosion proof coat. A minimal bending radius 2T is adopted in accordance with recommendations of metal sheets producers, where T stands for metal sheet thickness. Such recommendations limit producers of roof coverings in developing of new shapes of modular roofing sheets.

In addition, modular roofing sheets of low profile and having relatively lots of even surfaces characterises by a low transverse stiffness of the sheets. At sites of bending at small radius, there is possible so-called sheet corrugation, and at stamping sites—so-called a sheet stretching often occurs.

In case of bending at 90° angle, all tensile stresses appear at one site on small area, what results in the cracks of lacquer, corrosion proof and decorative coats at that site.

The roofing materials are subjects to a wind load (over- and underpressure). The air stream moving along a windward roof surface presses the roof surface with the covering against the roof structure. The wind passing through the rafters upwards and through the ridge, falling on the opposite (leeward) side, speeds up resulting in wind uplift of the roofing against the roof structure.

Therefore, the more aerodynamic shape of the roofing is, the mentioned above wind loads on the roof surfaces are smaller.

From the website https://www.budmat.com/pl/produkt/murano-klasycznie-czy-murano-73 there is known a modular tile-like roofing sheet with pre-prepared mounting holes and embossments, which shorten mounting and facilitate the precise matching of sheets and corrections of whole surface after their binding each other. The sub-ribs done along the ribs ensure invisibility of the transverse joints and provide additional stiffening of the roofing sheets. Rolling up the bottom edge of the sheet ensures better water drainage from the roof surface and prevents water retention.

Known from the Polish patent application no. P423223, a metal roof tile module, a metal roof tile module having two planes, separated by a central end wall and ending with a lower and upper end wall, respectively, characterized by the fact that each plane is flat and is divided into separate flat quadrilateral parts, pairs of which are non-adjacent, they are slightly forward and lie slightly lower. The flat quadrilateral parts of the planes terminate at the top with a flat oblique section extending at an angle $\alpha$ and joining the middle or top end wall.

The transitions between the described parts of the roof tile module are radial.

A roof tile is known from the Polish patent description no. PL185782 in the form of a rectangular sheet with a predetermined length and width, with at least one shaped step and at least one channel located along the length of the tile, characterized by the fact that it has a series of steps along its length, each step has opposite edges and a fault wall in between. Along one edge of the steps, there is a single groove along the length of the roof tile containing the fault wall. At the opposite edge of the steps, discontinuous projections are formed along part of the edge. The projections and the groove are assembling elements of adjacent roofing tiles.

An element in form of an elongated rectangle is known from the Polish application for a utility model no. W097297, characterized by the fact that its surface on the side of one of the longer sides has alternately larger concave embossings and smaller stiffening recesses, which form the assembly step upwards compared to those made on the entire remaining the surface of the element of larger concave embossments and smaller stiffening recesses ending on the second long side with a mounting bend with a shape coinciding with the shape of the wall forming the assembly step. The edges of the larger concave embossings on the step side and the folds are rounded, and the edges of the stiffening recesses on the same side form protrusions. The edges of the shorter sides of the element are finished with assembly notches, the surfaces of which smoothly pass from the recess in the protrusion.

It is known from the Polish application description P379919, a roof panel intended especially for use in roofing of buildings, provided with undulating concave-convex ribs, transverse rising slants, characterized by the fact that it has an assembling buttress slope inclined to the outer plane of the roofing and the gripping wing at an angle "A" of 90° and is provided with fixed catches and has an external resilient abutment haunch inclined to the outer plane of the cover at an angle "B" of preferably 90° and is provided with locking catches.

There is known from the European patent specification no. EP0115968B1 a sheet metal cladding element, which is intended in use to span and to be secured to at least two structural members of a building. The cladding element comprises a panel portion having opposed side edges and opposed top and bottom edges extending in a lateral direction between the side edges, a ridge extending along the top edge of the panel portion, the ridge including an inner wall which forms an upwardly projecting extension of the panel portion, a plurality of upwardly projecting inverted channel-shaped ribs formed in the panel portion and extending from the inner ridge wall towards the lower edge of the panel portion and a downwardly projecting edge formed and extending along the lower edge of the panel portion. The element characterises by that the ridge (15) is shaped as an inverted channel having substantially parallel inner and outer side walls. A series of recesses are formed in the inner wall of the ridge, each recess being in alignment with one of the ribs and defining a cavity into which the associated rib extends. the lower edge of the panel portion, including the lip, is scalloped inwardly in alignment with and for substantially the full width of each of the ribs.

From the Polish patent description no. PL228238, a roofing element is known, made of a plate material, consisting of a first and second side edge, an upper edge and a lower edge, having a series of modules substantially parallel to the side edges forming the lower surface and the upper surface, containing ribs parallel to the top and bottom edges. The rib on the lower edge in the cross-section has the form of a lower bend forming a right angle with the lower surface and in the upper part an arc connected to the lower surface. The rib on the upper edge in the cross-section is in the form of an upper bend forming a right angle with the upper surface and the end surface of the roofing element. The upper bend in its lower part has a semicircular bend towards the outside of the roofing element in the direction in which the end face of the roofing element, which is connected to the upper face, is directed.

From the Polish patent description no. PL226086, a roofing element is known, made of a plate material, consisting of a first and a second side edge, an upper edge and a lower edge, having a series of modules substantially parallel to the side edges forming the lower surface and the upper surface, including ribs parallel to the top and bottom edges. The embossment on the lower edge in the cross-section has the form of a lower bend forming a right angle with the lower surface and in the upper part an arc connected to the lower surface. The embossment on the upper edge in the cross-section is in the form of an upper bend forming a right angle with the upper surface and the end surface of the roofing element. The upper bend in its lower part has a semicircular bend towards the outside of the roofing element in the direction in which the end face of the roofing element, which is connected to the upper face, is directed.

The essence of a roof covering element, a modular roofing sheet according to the invention, made of a plate material, consisting of a first and second side edge, an upper edge and a lower edge, having a series of modules substantially parallel to the side edges forming at least one surface, containing ribs (walls) parallel to the upper and lower edges, characterised by that between an upper wall and an ending surface of the roof covering element there is an upper crease forming an obtuse angle with the ending surface of the roof covering element. Between each of {n} central walls and each of {n} surfaces there is a central crease forming an obtuse angle with a central wall and an obtuse angle with the surface. Between a lower wall and an extreme lower surface there is a lower crease forming an obtuse angle with the lower wall and an obtuse angle with the extreme lower surface. n is a natural number of $n \geq 0$.

Each module situated at the extreme lower surface comprises at least one formed rib, preferably arranged symmetrically two formed ribs, which extension over a part being on {n} central wall is a formed rib on {n} surface, wherein n=1. Each module being on the surface comprises at least one formed rib, preferably arranged symmetrically two formed ribs, which extension over a part being on {n+1} central wall is a formed rib on {n+1} surface, wherein $n \geq 1$.

The formed rib on an upper surface has an upper ending placed on an upper wall and on ending surface.

The formed rib on an extreme lower surface has a lower ending placed on a lower wall.

A horizontal surface of upper ending lying on the ending surface is over the ending surface. The flat horizontal surface of upper ending lying on the upper wall and the upper crease in form of double-bend is below surface of the upper wall and surface of the upper crease in form of double-bend.

A horizontal surface of the formed rib lying on the extreme lower surface is above the extreme lower surface.

A flat surface of part of a rib lying on {n} central wall and {n} central crease in form of double-bend is below surface of {n} central wall and {n} surface of central crease in form of double-bend, wherein $n \geq 1$.

A flat surface of lower ending lying on the lower wall and on the lower crease in form of double-bend is below surface of the lower wall and surface of the lower crease in form of double-bend.

Preferably part or whole surface of a roof covering element, a modular roofing sheet according to the invention is knurled or covered by microwaves.

Preferably the upper wall, the central wall and the lower wall of a roof covering element, a modular roofing sheet according to the invention has pre-prepared at least one mounting hole or at least one mounting embossment with a hole.

The roof covering element, a modular roofing sheet according to the invention:

- preferably between extreme lower surface and {n} central wall has pre-prepared an extrusion, where n=1, whereby for n=0 the extrusion is between the extreme lower surface and the upper wall,
- preferably between each{n} surface and each {n+1} central wall, wherein $n \geq 1$, has pre-prepared extrusion,
- preferably between the extreme upper surface and the upper wall has pre-prepared extrusion.

Preferably the lower edge of the lower wall of a roof covering element, a modular roofing sheet according to the invention has formed bend.

The roof covering element, a modular roofing sheet according to the invention:

- facilitates quick and easy assembling, precise mounting the sheets and correction of whole roof covering after their mounting,
- provides better stiffness of sheets and invisibility of transverse links,
- thanks to double-bend it is possible to distribute bending forces on a larger surface,
- by applying two smaller bending radii, it allows to reduce local stress arising during bending, and thus to lower temperature of a sheet processing—the possibility of sheet production at lower temperatures,
- increases resistance to corrosion by applying two smaller radii and larger bending angle at the creases, which minimises lacquer cracking (scratches, unevenness, tears) during stamping,
- by increasing the transverse stiffness of a module and an entire sheet of roofing tile as a result of creases, it provides better aerodynamics of the front surfaces against wind uplift and lower suction force of the roofing surface, which reduces the vibrations of the roof slope caused by external forces,
- provides reduced pollution retention on its surface, particularly at the creases z by easier washing with rainwater,
- reduces material consumption in comparison with the traditionally shaped steel roof tiles by using a crease (savings over 1%, material batch less by 9 mm in a steel roof tile with two modules) while maintaining the visual effect of high embossing—light reflection on two planes.

The subject of the invention is presented in exemplary embodiments in drawings on which:

EMBODIMENT

Figure 1:
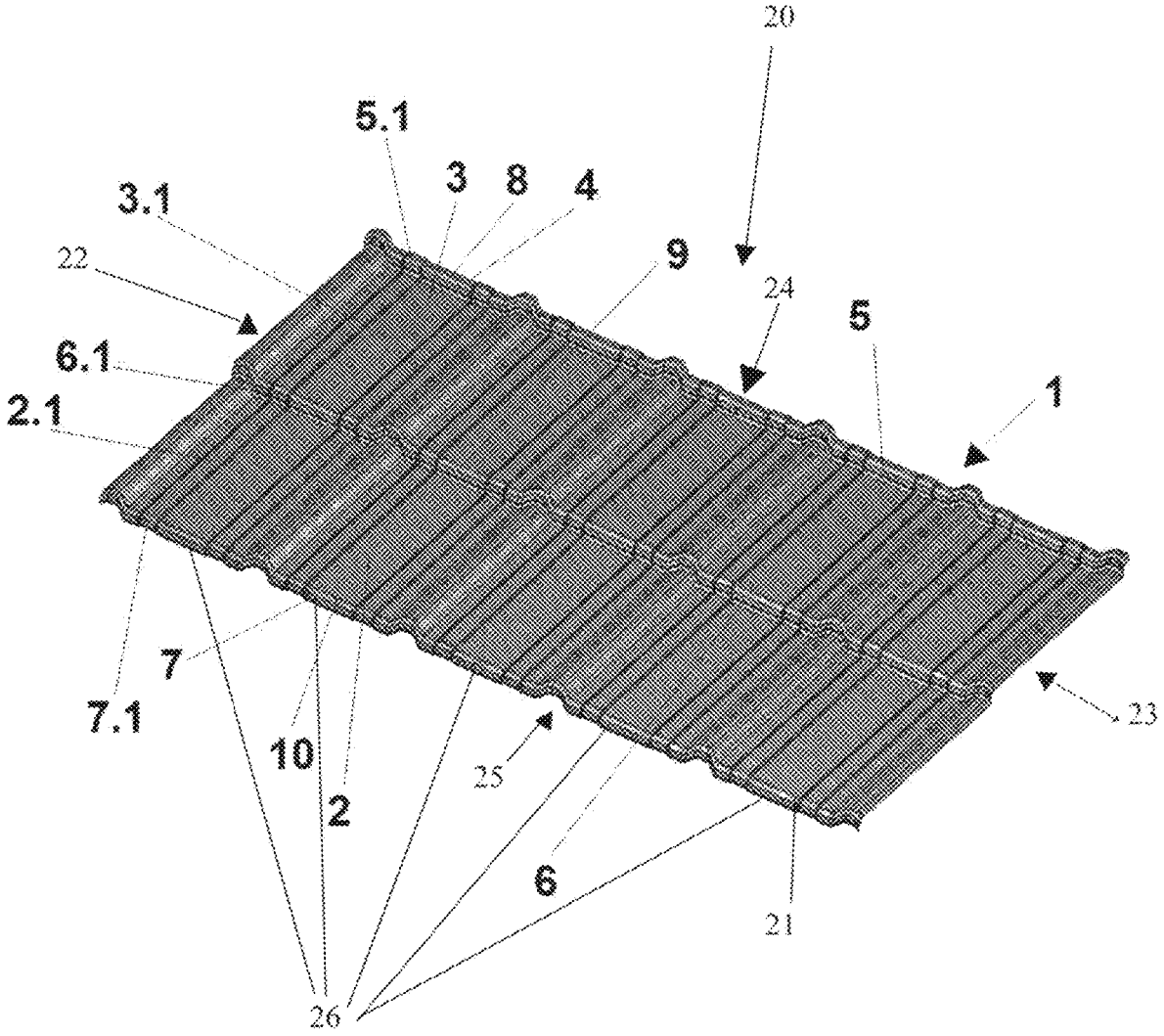
FIG. 1 shows the element according to the invention in axonometric view.
Figure 2:
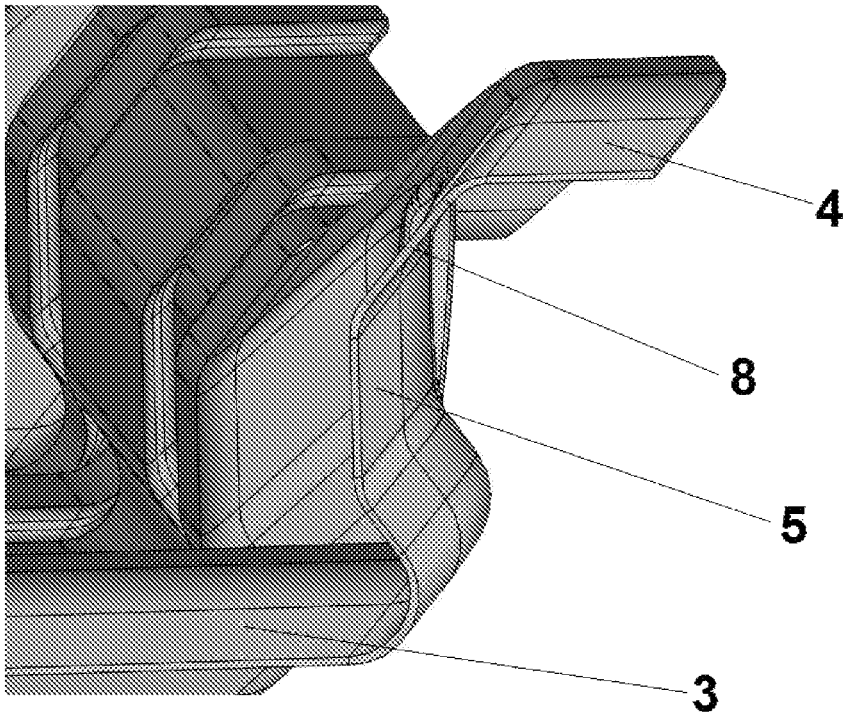
FIG. 2 shows a partial side view with an upper embossment.
Figure 3:
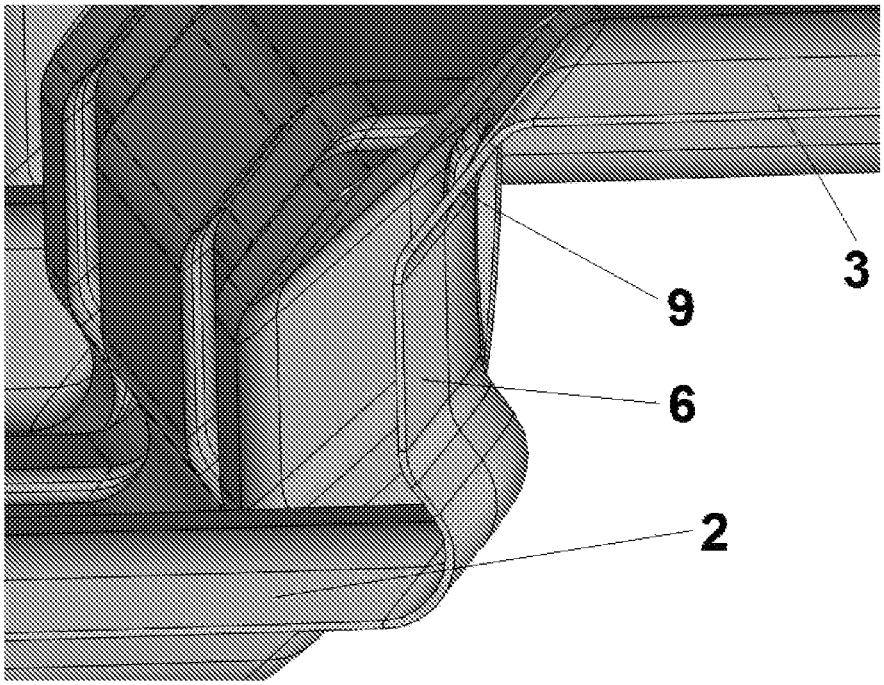
FIG. 3 illustrates a partial side view with a central embossment.
Figure 4:
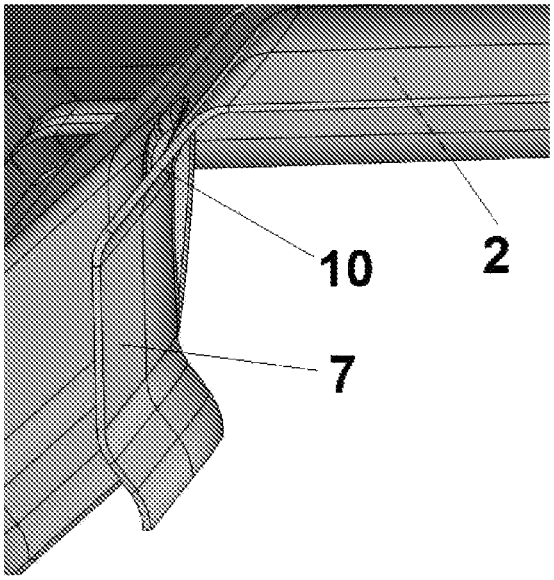
FIG. 4 shows a partial side view with a lower embossment.
Figure 5:
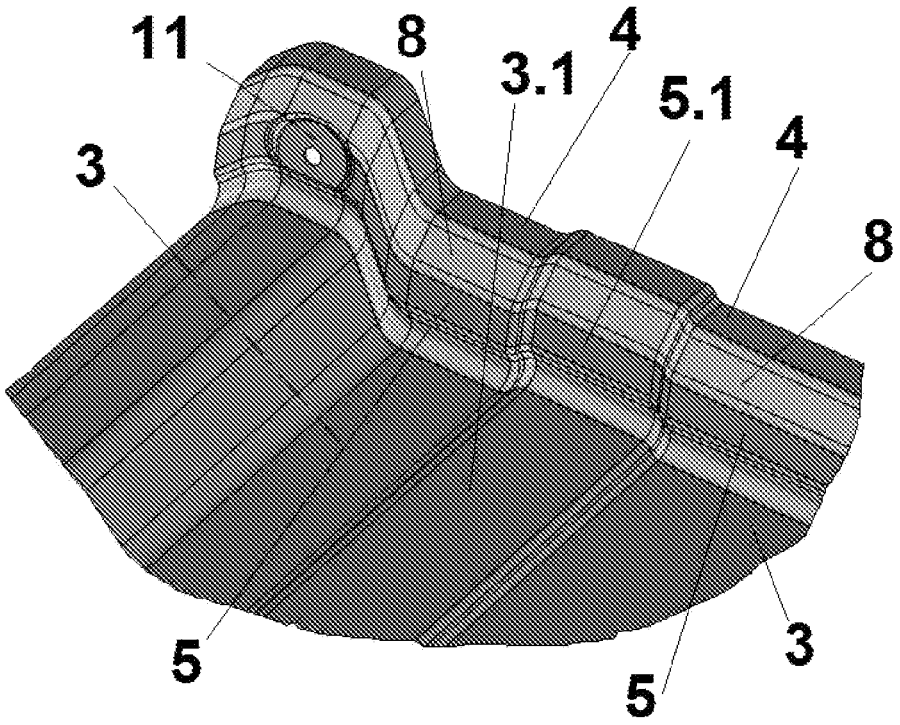
FIG. 5 shows a partial axonometric view of an upper ending.
Figure 6:
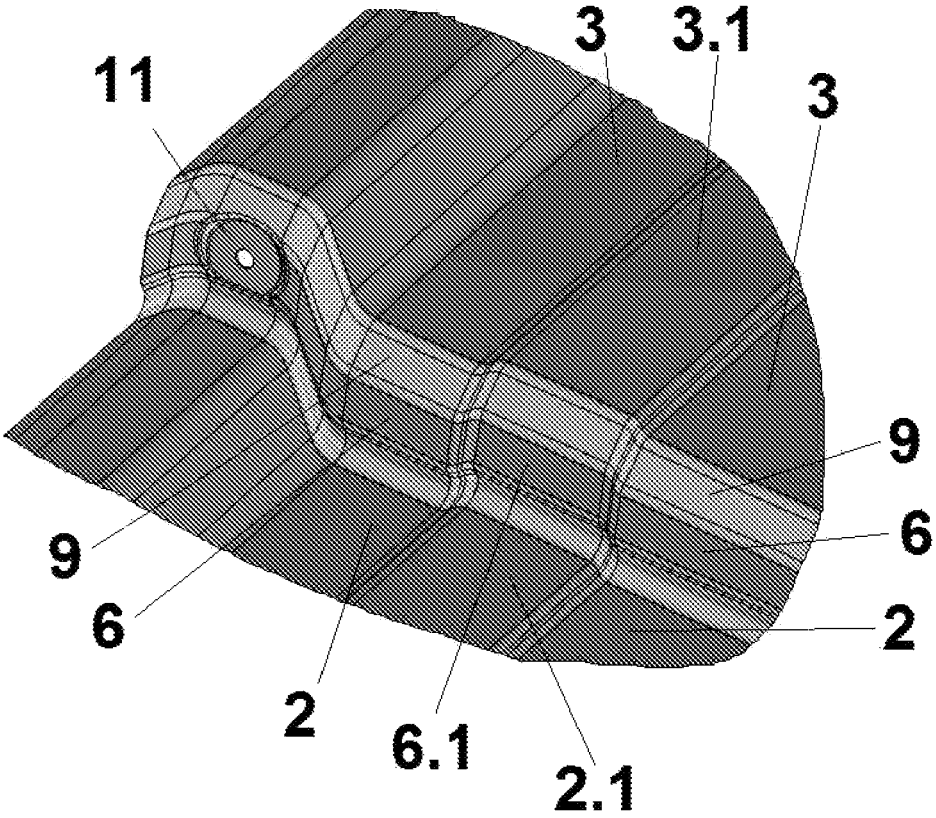
FIG. 6 shows a partial axonometric view of a part of a rib on central embossment.
Figure 7:
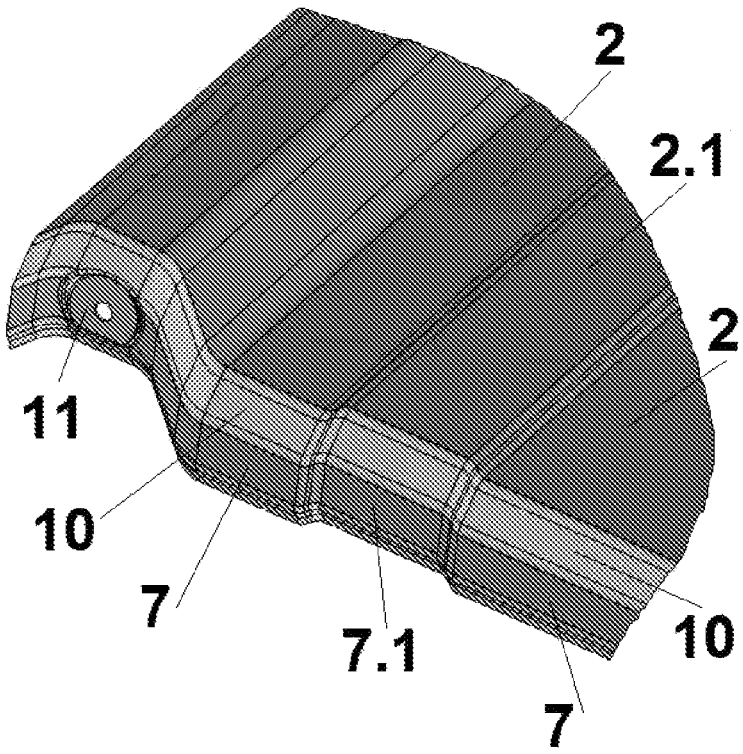
FIG. 7 shows a partial axonometric view of a lower ending.
Figure 8:
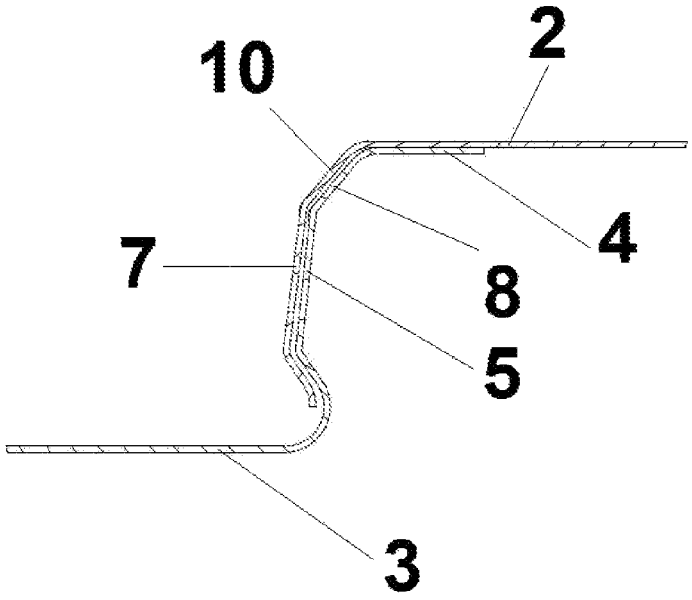
FIG. 8 shows a partial cross-section of superimpose site of adjacent elements according to the invention
Figure 9:
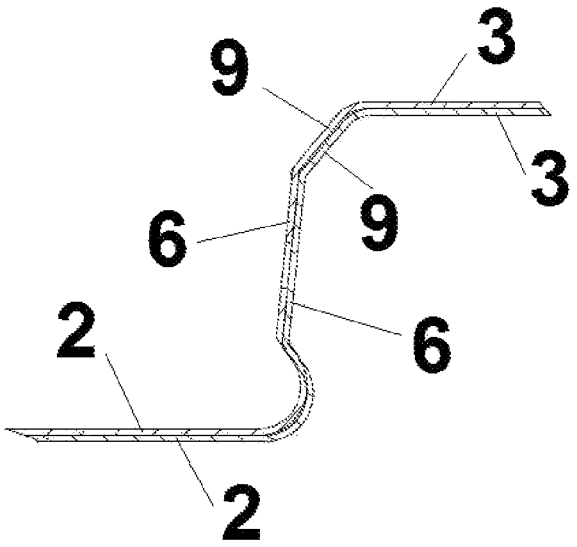
FIG. 9 shows a partial cross-section of other superimpose site of adjacent elements according to the invention

A roof covering element, a modular roofing sheet 20, made of a plate material 21, consisting of a first and second side edge (22, 23), an upper edge and a lower edge (24, 25), having a series of modules (26) substantially parallel to the side edges forming at least one surface, containing ribs (walls) parallel to the upper and lower edges, characterised by that between an upper wall 5 and an ending surface 4 of the roof covering element 1 there is an upper crease 8 forming an obtuse angle with the ending surface 4 of the roof covering element 1. Between each of {n} central walls 6 and each of {n} surfaces 3 there is a central crease 9 forming an obtuse angle with a central wall 6 and an obtuse angle with the surface 3. Between a lower wall 7 and an extreme lower surface 2 there is a lower crease 10 forming an obtuse angle with the lower wall 7 and an obtuse angle with the extreme lower surface 2. n is a natural number of n≥0.

Each module situated at the extreme lower surface 2 comprises at least one formed rib 2.1, preferably arranged symmetrically two formed ribs 2.1, which extension over a part 6.1 being on {n} central wall 6 is a formed rib 3.1 on {n} surface 3, wherein n=1. Each module being on the surface 3 comprises at least one formed rib 3.1, preferably arranged symmetrically two formed ribs 3.1, which extension over a part 6.1 being on {n+1} central wall 6 is a formed rib 3.1 on {n+1} surface 3, wherein n≥1.

The formed rib 3.1 on an upper surface 3 has an upper ending 5.1. placed on an upper wall 5 and on ending surface 4.

The formed rib 2.1 on an extreme lower surface 2 has a lower ending 7.1 placed on a lower wall 7.

Flat horizontal surface of upper ending 5.1 lying on the ending surface 4 is over the ending surface 4, the flat horizontal surface of upper ending 5.1 lying on the upper wall 5 and the upper crease 8 in form of double-bend is below surface of the upper wall 5 and surface of the upper crease 8 in form of double-bend.

Horizontal surface of the formed rib 2.1 lying on the extreme lower surface 2 is above the extreme lower surface 2.

A flat surface of part 6.1 of a rib lying on {n} central wall 6 and {n} central crease 9 in form of double-bend is below surface of {n} central wall 6 and {n} surface of central crease 9 in form of double-bend, wherein n≥1.

A flat surface of lower ending 7.1 lying on the lower wall 7 and on the lower crease 10 in form of double-bend is below surface of the lower wall 7 and surface of the lower crease 10 in form of double-bend.

Preferably part or whole surface of a roof covering element, a modular roofing sheet according to the invention is knurled or covered by microwaves.

Preferably the upper wall 5, the central wall 6 and the lower wall 7 of a roof covering element, a modular roofing sheet according to the invention has pre-prepared at least one mounting hole or at least one mounting embossment 11 with a hole.

The roof covering element, a modular roofing sheet according to the invention:

- preferably between extreme lower surface 2 and {n} central wall 6 has pre-prepared an extrusion, where n=1, whereby for n=0 the extrusion is between the extreme lower surface 2 and the upper wall 5,
- preferably between each{n} surface 3 and each {n+1} central wall 6, wherein n≥1, has pre-prepared extrusion,
- preferably between the extreme upper surface 3 and the upper wall 5 has pre-prepared extrusion.

Preferably the lower edge of the lower wall 7 of a roof covering element, a modular roofing sheet according to the invention has formed bend.

The invention claimed is:

1. A roof covering element (1) formed as a modular roofing sheet (20), made of a plate material (21), comprising a first side edge (22) and second side edge (23), an upper edge (24) and a lower edge (25), having a series of multiple modules (26) substantially parallel to the side edges forming at least one surface, comprising walls (5, 6, 7) parallel to the upper edge (24) and lower edge (25), wherein:

- between an upper wall (5) and an ending surface (4) of the roof covering element (1) there is an upper crease (8) forming an obtuse angle with the upper wall (5) and an obtuse angle with the ending surface (4) of the roof covering element (1), wherein both of the obtuse angles have an interior beneath the roof covering element (1) and wherein the interiors partially overlap;
- between a central wall (6) and an upper surface (3) there is a central crease (9) forming an obtuse angle with the central wall (6) and an obtuse angle with the upper surface (3), wherein both of the obtuse angles have an interior beneath the roof covering element (1) and wherein the interiors partially overlap;
- between a lower wall (7) and an extreme lower surface (2) there is a lower crease (10) forming an obtuse angle with the lower wall (7) and an obtuse angle with the extreme lower surface (2), wherein both of the obtuse angles have an interior beneath the roof covering element (1) and wherein the interiors partially overlap.

2. The element according to claim 1, wherein in each module (26) the extreme lower surface (2) comprises at least one formed rib (2.1), or two formed ribs (2.1) arranged symmetrically within the module (26), the rib (2.1) extends over the central wall (6) forming a central rib (6.1) on the central wall and further extends over the upper surface (3) forming an upper rib (3.1) on the upper surface (3).

3. The element according to claim 2, wherein the upper rib (3.1) on the upper surface (3) has an upper ending (5.1) placed on the upper wall (5) and on the ending surface (4).

4. The element according to claim 2, wherein the at least one formed rib (2.1) on the extreme lower surface (2) has a lower ending (7.1) placed on the lower wall (7).

5. The element according to claim 2, wherein a flat horizontal surface of an upper ending (5.1) lying on the ending surface (4) is over the ending surface (4), the flat horizontal surface of the upper ending (5.1) lying on the upper wall (5) and the upper crease (8) forming a double-bend below a surface of the upper wall (5) and a surface of the upper crease (8).

6. The element according to claim 2, wherein a horizontal surface of the at least one formed rib (2.1) lying on the extreme lower surface (2) is above the extreme lower surface (2).

7. The element according to claim 2, wherein a flat surface of the central rib (6.1) lying on the central wall (6) and the central crease (9) forms a double-bend below the central wall (6) and the central crease (9).

8. The element according to claim 1, wherein a flat surface of a lower ending (7.1) lying on the lower wall (7) and on the lower crease (10) forms a double-bend below the lower wall (7) and the lower crease (10).

9. The element according to claim 1, wherein a part or a whole of the surface is knurled.

10. The element according to claim 1, wherein the upper wall (5), the central wall (6) and the lower wall (7) have a pre-prepared at least one mounting hole or at least one mounting embossment (11) with a hole.

11. The element according to claim 1, wherein between the extreme lower surface (2) and the central wall (6) there is a pre-prepared extrusion, between the upper surface (3) and the upper wall (5) there is a pre-prepared extrusion, and wherein a lower edge of the lower wall (7) has a formed bend.

* * * * *